United States Patent [19]

Johnson et al.

[11] Patent Number: 4,790,386

[45] Date of Patent: Dec. 13, 1988

[54] METHOD AND MEANS FOR INTRODUCING TREATMENT COMPOSITION INTO A WELL BORE

[75] Inventors: Irvin D. Johnson, Englewood; Charles R. Bruce, Littleton, both of Colo.

[73] Assignee: Marathon Oil Company, Findlay, Ohio

[21] Appl. No.: 150,810

[22] Filed: Feb. 1, 1988

[51] Int. Cl.[4] ..... E21B 41/02

[52] U.S. Cl. ..... 166/310; 166/117; 166/162; 166/902; 206/524.7

[58] Field of Search ..... 166/902, 162, 164, 310, 166/311, 117, 376, 371; 206/524.7; 252/8.555

[56] References Cited

U.S. PATENT DOCUMENTS

| | | | |
|---|---|---|---|
| 2,635,996 | 4/1953 | Rohrback et al. | 166/310 |
| 2,728,400 | 12/1955 | Rohrback | 166/310 X |
| 2,744,880 | 5/1956 | Brown | 166/902 X |
| 2,775,302 | 12/1956 | Kirkpatrick | 166/1 |
| 3,190,373 | 6/1965 | Weathersby | 206/524.7 X |
| 4,611,664 | 9/1986 | Osterhoudt, III et al. | 166/902 |
| 4,670,166 | 6/1987 | McDougall et al. | 166/902 X |

*Primary Examiner*—Stephen J. Novosad
*Assistant Examiner*—Bruce M. Kisliuk
*Attorney, Agent, or Firm*—Jack L. Hummel; Rodney F. Brown

[57] ABSTRACT

Treatment composition is released into a well by lowering a container filled with the composition to the bottom of the well. The corrosive well fluid dissolves the composition through the open upper end of the container and corrodes away the walls of the container from the inside out. The outer surface of the container walls is coated with a material, such as tetrafluoroethylene, which acts as a barrier to the well fluid to prevent it from directly contacting the outer wall surface. In this manner treatment composition is gradually released from the top end of the ever-diminishing length of container and the container is degraded in the well.

16 Claims, 2 Drawing Sheets

METHOD AND MEANS FOR INTRODUCING TREATMENT COMPOSITION INTO A WELL BORE

FIELD OF THE INVENTION

This invention relates to the treatment of a well bore through the introduction of treatment composition into the well. More particularly, it relates to a method and means for introducing treatment composition from a degradable container.

BACKGROUND OF THE INVENTION

Conditions in a producing fluid well such as an oil or gas well often require the introduction of treatment chemicals. For example, inhibitors to prevent corrosion scale build-up, waxing or other undesirable conditions are commonly introduced as required in a variety of ways. Chemicals in liquid form have been introduced by being pumped or poured down the tubing string or the production string, and have also been injected through separate strings of tubing. All of these methods, however, suffer from major disadvantages. The use of additional strings of tubing is costly and can interfere with other operations, while the use of liquid chemicals can require great quantities in order to ensure adequate distribution throughout the well, at an excessively high cost.

Treatment compositions have also been introduced from containers which are designed to release the composition after reaching the point in the well where it is desired to have the treatment begin. One approach has been to utilize a carrier which is dissolved by the treatment composition itself, an example of which is disclosed in U.S. Pat. No. 4,611,664 to Osterhoudt, III et al. In this arrangement the well is taken off production and the carrier, which is designed to disintegrate shortly after it reaches the bottom of the well, is dropped into the well. After a period of time the well is returned to production. The resulting flow of well fluid causes the liquid chemical composition to mix with the well fluid. This method of treatment does not lend itself to wells containing fluid which is highly corrosive or which precipitates scale at a rapid rate because the treatment would have to be carried out so often that it would be impractical to take the well off production each time. Further, the concentration of treatment liquids is difficult to control since the manner of introduction in effect is a batch treatment process.

The use of solid treatment material in the form of shaped rods has been suggested, but this approach also suffers from problems similar to those discussed above. Well production normally is interrupted during the period of treatment, which preferably should be avoided if practicable. Further, the rapid disintegration of the rods results in a batch process type of treatment, with consequent difficulties in accurately controlling the treatment operation.

It has also been suggested to provide a container which would release treatment composition over a longer span of time. Such an arrangement is disclosed in U.S. Pat. No. 2,775,302 to Kirkpatrick, wherein a carrier separated into several compartments is disclosed. By making the walls separating the compartments of varying thickness the well fluid is caused to corrode through the thinner walls first, thereby releasing the chemicals in the compartment bounded by those walls. The chemicals in the other compartments are subsequently released when their thicker walls are corroded away. In this manner the treatment period is extended over a period of days. Although the treatment extends over a greater period of time than the previously described processes, it is still basically a batch treatment process, since all of the chemicals within a particular compartment are released at the same time. It is merely the interval between releases that is controlled. Such an arrangement does not provide for the steady introduction of controlled amounts of chemicals suitable for use in a well which contains highly corrosive well fluid and which therefore requires greater overall quantities of treatment composition to be introduced.

Still another way of introducing treatment composition is disclosed in U.S. Pat. No. 2,635,996 to Rohrback et al. In that patent a metal shell one to four feet in length is filled with a treatment composition, and the open end is either narrowed by pinching it together until only a narrow space remains or is sealed with a high melting point wax. The treatment composition is a solid and is dissolved by the well fluid at the top of the metal shell until the shell disintegrates in about 24 hours. Thus even though the composition is released into the well over a period of time, the release period itself is so short as to simply constitute another variation of a batch-type chemical introduction process.

Instead of the short term introduction methods of the prior art, with their resulting problems of cost and control, it would be highly desirable to develop a well treatment method which is operative over a long period of time and which can be designed to introduce compositions into a well at predetermined rates. It would also be desirable to do this without having to interrupt well production over this period of time.

BRIEF SUMMARY OF THE INVENTION

This invention introduces a treatment composition into a well containing corrosive fluid by loading an elongated container with a non-porous treatment composition adapted to dissolve in the well fluid, then lowering the loaded container into the well. The container includes side walls which are adapted to be corroded away by the well fluid, but steps are taken to prevent the outer surface of the side walls from being so corroded. By exposing the treatment composition to the well fluid at an end of the container, the treatment composition at that point is dissolved, further exposing to the well fluid the adjacent inner surface of the container walls which previously had been covered by the dissolved treatment composition. As this action continues to take place the container walls are progressively eroded away along the length of the container.

Because the containers can be made very long, limited in practice by the length which can conveniently be loaded into the well, the time it takes for the treatment composition to be fully exhausted can readily extend over a period of months. The rate at which the composition is dissolved into the well fluid can be controlled by the first determining the corrosive nature of the well fluid, then designing the container and selecting the treatment composition so that the composition is dissolved at a desired rate complementary to the rate at which the walls of the container are corroded. Furthermore, the means by which the outer surface of the container walls is protected from corrosive attack by the well fluid, although quite simple, is highly effective.

Other features and aspects of the invention, as well as its various benefits, will be ascertained from the more detailed description of the invention which follows.

DESCRIPTION OF THE PREFERRED EMBODIMENT

Figure 1:
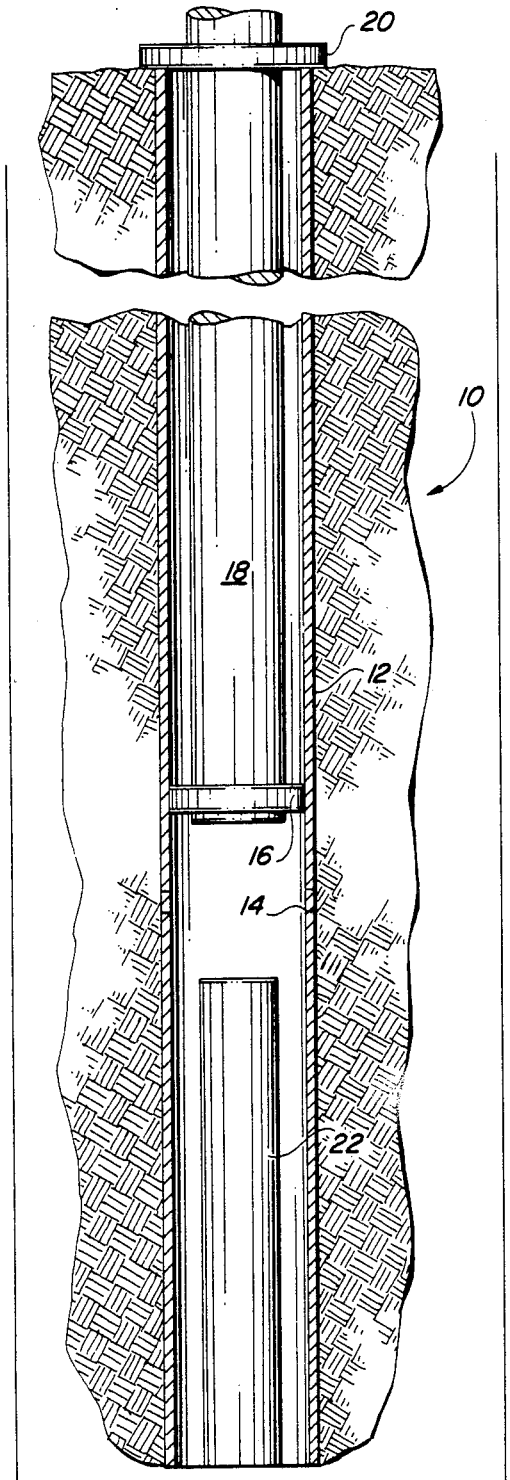
FIG. 1 is a partial longitudinal sectional view schematically showing a fluid well bore incorporating the treatment composition container of the present invention.

Referring to FIG. 1, a well bore 10 includes a casing 12 containing production perforations 14. A packer 16 located above the perforations 14 seals the annular space between the casing 12 and tubing string 18. The well terminates in the well head 20, and although it is understood that the tubing string extends above the well head and is connected to other equipment common to well bore installations, such other equipment is not shown since it does not form a part of the present invention. The treatment composition container 22 of the present invention is illustrated at the bottom of the well bore after it has been lowered into place, as for example by a wire line. The container would normally be below the production perforations but could be set higher if it is found that there is insufficient circulation at the lower location to adequately move the treatment composition throughout the well.

Figure 2:
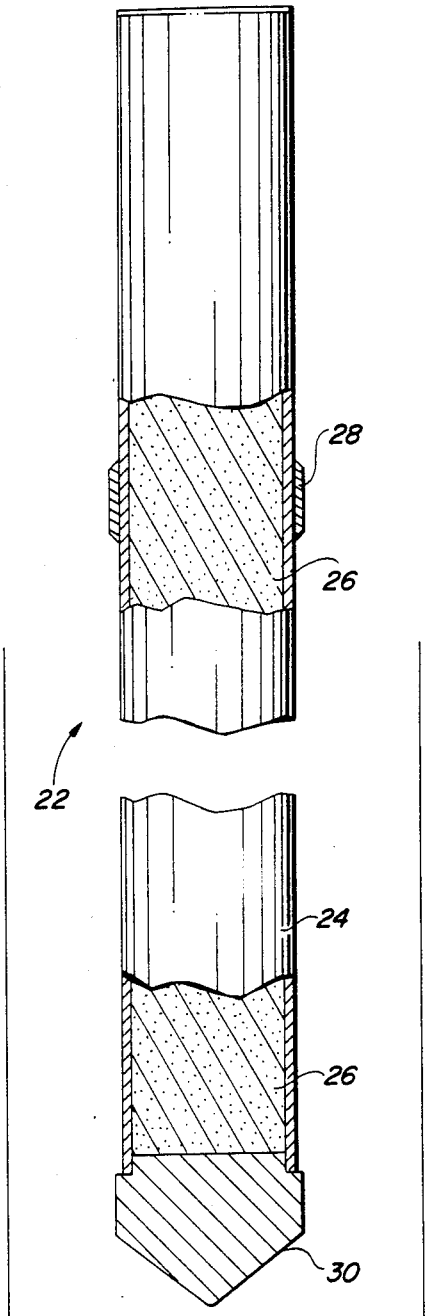
FIG. 2 is an enlarged partial longitudinal sectional view of the treatment composition container of the invention.

Referring to FIG. 2, the container 22 comprises a cylinder 24 filled with treatment composition 26. One or more conventional skid rings 28 may be provided at spaced intervals along the length of the cylinder 24 to assist in the lowering of the container into the well bore. A bottom plug 30 is provided to close off the lower end of the cylinder and to assist in guiding the cylinder down through the tubing string 18. The cylinder may be fabricated from any suitable material which possesses enough strength to carry the treatment composition and to withstand the physical stresses of its trip down the tubing string. The material must also be able to withstand the heat and pressure to which it is exposed at the bottom of the well bore. It must further be corrodible by the well fluid but not by the treatment composition. It is preferred that the cylinder be formed of aluminum, magnesium or alloys thereof, or of any other material which meets the criteria set forth above.

Figure 3:
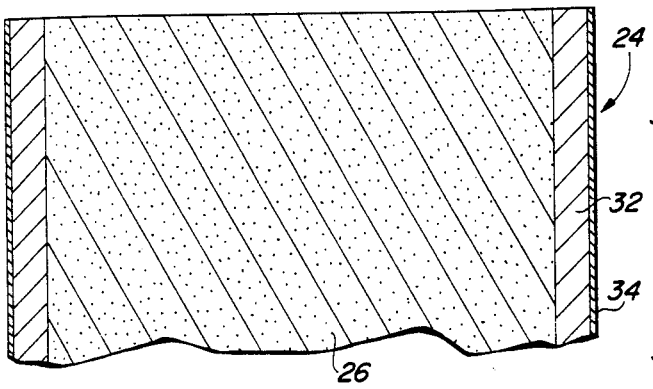
FIG. 3 is a more greatly enlarged partial longitudinal cross-sectional view of the top end portion of the treatment composition container of the invention.

Referring to FIG. 3, it can be seen that the inner surface of the walls 32 of the cylinder 24 is in contact with the treatment composition 26. The outer wall surface is coated with a layer of coating material 34 which prevents well fluid from contacting the corrodible outer surface. Although any suitable coating material which acts as a barrier to the well fluid may be employed, the coating should not be self-supporting as the canister corrodes away since this would defeat the intent of providing a degradable container. An example of a suitable material is a thinly sprayed tetrofluoroethylene coating, such as Teflon or Silverstone. The upper end of the cylinder 24 is illustrated as being open so that the upper surface of the treatment composition 26 is exposed to the well fluid.

The treatment composition may be for any of the usual treatment purposes, in most cases comprising chemicals suitable for inhibiting the formation of scaling or wax or for preventing corrosion of metal surfaces in the well bore. Such chemicals are well known in the industry and may be selected according to the requirements of the particular well in question. The composition should, however, be soluble in the well fluid and be provided in non-porous form so as to form a barrier to the travel of well fluid through the composition. A semi-solid inhibitor, such as alkaline salts of phosphate, phosphorates, acrylates or sulfonates, or an inhibitor in a polymer solution, such as polyacrylate, polymethacrylate or polyacrylamide, are examples of compositions which meet these criteria.

Figure 3A:
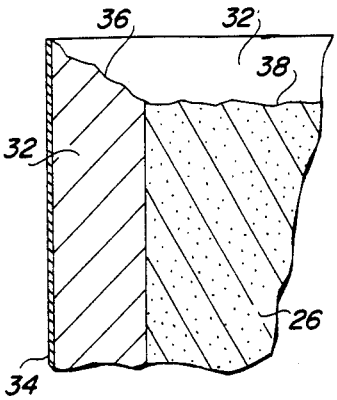
FIG. 3A is a still greater enlarged longitudinal cross-sectional view of a top end portion of the container of FIG. 3, illustrating the corroding effect of the well fluid on the container wall.

In the arrangement shown in FIG. 3 the upper surface of the treatment composition 26 is flush with the top of the cylinder walls 32 and initially prevents the well fluid from contacting the inner surface of the walls. Although the fluid cannot migrate through the composition due to the nonporous structure of the composition, it will dissolve the portion of the treatment composition with which it comes into contact. Thus the well fluid will progressively dissolve the treatment composition from the open top end of the container to the bottom, and in the process will progressively engage and corrode the walls of the container starting at the top of the cylinder 32. Thus the cylinder walls are corroded away from the inside surface toward the outside surface, the latter remaining free from attack due to the protective layer 34. The result of this process is shown in FIG. 3A wherein the cylinder walls 32 have corroded away from the top down and from the inside out to leave the roughly diagonal edge 36. The treatment composition has dissolved from the top down to leave the upper roughly horizontal surfaces 38. It should be clear that the rate at which the treatment composition goes into solution can be controlled by the particular chemicals involved and by the physical form of the composition. The rate at which the container is corroded away is partially dependent upon the rate at which the inner wall surface is exposed by the dissolving composition 26 as well as by the wall thickness and the particular container material used. These parameters will necessarily change from one well to another according to the characteristics of the well fluid.

Figure 4:
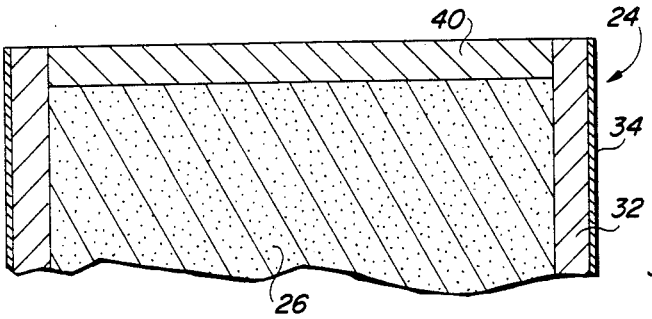
FIG. 4 is a view similar to that of FIG. 3, but showing a modified container end design.
Figure 4A:
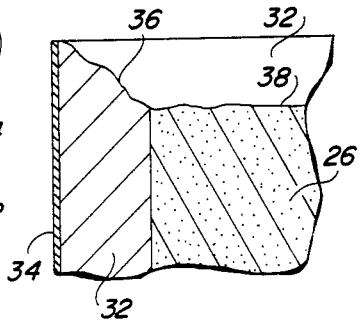
FIG. 4A is a view similar to that of FIG. 3A, but illustrating the corrosive effect of the well fluid on the wall of the container of FIG. 4.

Instead of leaving the top of the container open as in the FIG. 3 arrangement, the top may be closed as shown in FIG. 4, wherein a suitable wax seal 40 is provided. Although such a configuration would not ordinarily be required in view of the relatively short installation time compared to the inhibitor release time, it may at times be preferred. If such an arrangement is utilized, any of the commonly used high-temperature waxes may be utilized for this purpose as is well known in the art. Even though the inner surface of the cylinder 32 initially covered by the wax will be exposed to the well fluid upon melting or disintegration of the wax, the corrosion of the cylinder walls 32 by the well fluid will proceed in the same direction as explained in connection with the FIG. 3 embodiment and will shortly be similar in appearance. This is illustrated in FIG. 4A.

Figure 5:
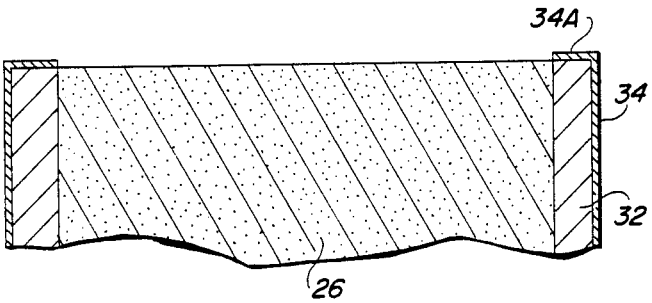
FIG. 5 is a view also similar to that of FIG. 3, but showing a further modified container end design.
Figure 5A:
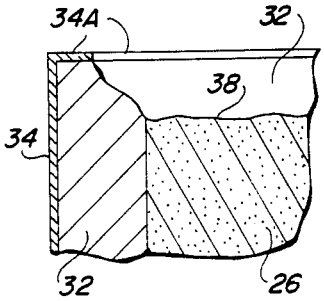
FIG. 5A is a view similar to that of FIG. 3A, but illustrating the corrosive effect of the well fluid on the wall of the container of FIG. 5.

It is not essential that the upper edge of the cylinder wall 32 be directly exposed to the well fluid. As shown in FIG. 5 it may be coated with a protective layer 34A as a continuation of the layer 34 on the outer surface of the side walls. This may be more convenient to do when coating the outside surface of the walls instead of leaving them uncoated. As shown in FIG. 5A, the initial corrosion path of the top portion of the cylinder walls may be slightly different from that of the uncoated embodiment of FIGS. 3 and 3A, but the overall process remains the same.

Other top end arrangements may be provided if desired, as long as they do not interfere with the intended manner of functioning of the container. For example, an open mesh screen may be provided over the open top end of the container if it is found necessary to restrain the treatment composition against movement out through the top of the container.

The container may be any desired length, but preferably is long enough to allow the treatment composition to be released over a long period of time. For example, a container having a diameter of 4 inches and a length of 40 feet is quite practical, which at a typical release rate of 1 pound of inhibitor per day could have a life expectancy of several months. A cylinder of such length can be formed of connected lengths of tubing, as is well known in the art, or can be made as an integral unit. Preferably, in order to receive the full benefits of the invention in terms of life expectancy, the container should be as large as possible, with the length being limited only by the largest size which can be loaded into the lubricator and the width or diameter being limited only by the largest size which can be moved through the tubing.

It should now be clear that the present invention provides a simple, economical method of introducing treatment chemicals into a well bore over an extended period of time without requiring the pumping or injecting of chemicals. Moreover, the degradable nature of the container allows the container to be simply set in place, with no further handling or other control operations being necessary.

It should also be obvious that although a preferred embodiment of the invention has been described, changes to certain of the specific details of the embodiment may be made without departing from the spirit and scope of the invention as defined in the appended claims.

What is claimed is:

1. A method of introducing a treatment composition into a well containing corrosive fluid, comprising the steps of:

loading an elongated container with a non-porous treatment composition adapted to dissolve in the well fluid, the container including side walls adapted to be corroded away by the well fluid;

lowering the loaded container into the well;

preventing the well fluid from corroding the outer surface of the side walls of the container; and exposing the treatment composition to the well fluid at an end of the container;

whereby the treatment composition exposed to the well fluid will dissolve therein and the well fluid will contact the adjacent inner surface of the container walls previously covered by the dissolved treatment composition, the container walls thus being progressively corroded away along the length of the container and the treatment composition progressively dissolving along said length of the container.

2. A method according to claim 1, wherein the well fluid is prevented from corroding the outer surface of the side walls of the container by a layer of material adhered to said outer surface.

3. A method according to claim 2, wherein the layer of material is not capable of being self-supporting as the side walls of the container are corroded away.

4. A method according to claim 3, wherein the layer of material comprises a coating comprising tetrofluoroethylene.

5. A method according to claim 2, wherein the treatment composition is adapted to slowly dissolve in the well fluid, whereby the introduction of the treatment composition and the corroding away of the container take place gradually.

6. A method according to claim 5, wherein the treatment composition is in the form of a semi-solid composition.

7. A method according to claim 5, wherein the treatment composition is in a polymer solution.

8. A method according to claim 2, wherein the treatment composition is exposed to the well fluid at the upper end of the container.

9. A method according to claim 8, wherein the upper end of the container is exposed to the well fluid as the container is lowered into the well.

10. A method according to claim 8, wherein the upper end of the container is closed as the container is lowered into the well by a cap adapted to dissolve or disintegrate in the well.

11. A container for holding and introducing treatment composition into a well containing corrosive fluid, comprising:

an elongated hollow container having side walls subject to corrosive attack by the well fluid;

the container carrying treatment composition in non-porous form, the treatment composition being adapted to dissolve in the well fluid;

a coating on the outside surface of the container side walls preventing the well fluid from contacting said outside surface;

an end of the container being adapted to permit the well fluid to contact the treatment composition adjacent said end to allow the well fluid to dissolve the treatment composition exposed thereto, thereby enabling the well fluid to reach the adjacent inner surface of the side walls of the container and progressively corrode away the side walls along the length of the container.

12. A container according to claim 11, wherein the coating is on the edge of the side walls at the top of the container.

13. A container according to claim 11, wherein the end of the container adapted to permit the well fluid to contact the treatment composition is the upper end of the container.

14. A container according to claim 11, wherein the coating comprises tetrofluoroethylene.

15. A container according to claim 11, wherein the side walls of the container are comprised of aluminum or alloys thereof.

16. A container according to claim 11, wherein the side walls of the container are comprised of magnesium or alloys thereof.

* * * * *